US007627990B2

(12) United States Patent
Yokomori et al.

(10) Patent No.: US 7,627,990 B2
(45) Date of Patent: Dec. 8, 2009

(54) WIRE WINDING APPARATUS

(75) Inventors: Kazuhito Yokomori, Yamanashi (JP); Masashi Shimizu, Yamanashi (JP); Hiroshi Satoh, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 269 days.

(21) Appl. No.: 11/488,731

(22) Filed: Jul. 19, 2006

(65) Prior Publication Data

US 2007/0084123 A1 Apr. 19, 2007

(30) Foreign Application Priority Data

Oct. 18, 2005 (JP) ..... 2005-303505

(51) Int. Cl.
*E05F 11/00* (2006.01)

(52) U.S. Cl. ..... 49/360

(58) Field of Classification Search ..... 49/360, 49/352; 296/155; 242/352; 254/296, 343; 74/425, 426, 665 F, 665 G
See application file for complete search history.

(56) References Cited

U.S. PATENT DOCUMENTS

| | | | | | |
|---|---|---|---|---|---|
| 2,609,170 | A | * | 9/1952 | Farrington et al. | 318/466 |
| 3,620,481 | A | * | 11/1971 | Stewart et al. | 242/352 |
| 4,044,632 | A | * | 8/1977 | Wildhaber | 74/665 G |
| 4,615,230 | A | * | 10/1986 | Guichard | 74/427 |
| 5,769,748 | A | * | 6/1998 | Eyerly et al. | 475/5 |
| 2005/0102905 | A1 | * | 5/2005 | Ichinose | 49/360 |

FOREIGN PATENT DOCUMENTS

| | | | |
|---|---|---|---|
| DE | 3433562 | A1 * | 5/1986 |
| JP | 2000-350406 | A | 12/2000 |

* cited by examiner

*Primary Examiner*—Jerry Redman
(74) *Attorney, Agent, or Firm*—Foley & Lardner LLP

(57) ABSTRACT

A wire winding apparatus winds one side of wire and simultaneously releases other side of wire by driving a winding actuator. A drive gear is disposed to rotate in an arbitrary direction when the winding actuator is driven. A pair of wire drums is disposed on both sides of the drive gear, respectively, and separately winds the one side of wire and the other side of wire in opposite directions. A rotation of the drive gear is transmitted to each of the wire drums.

3 Claims, 6 Drawing Sheets

WIRE WINDING APPARATUS

BACKGROUND OF THE INVENTION

1. Field of the Invention

The present invention relates to a wire winding apparatus that winds one side of wire and simultaneously releasing the other side of wire by driving a winding actuator.

2. Description of the Related Art

A vehicle like a four-wheel drive car includes a wire winding apparatus to open and close a slide door and a window glass. In general, the wire winding apparatus includes a worm wheel driven by an electric motor and a wire drum disposed on a side of the worm wheel. A pair of wires is wound around the peripheral surface of the wire drum in opposite directions.

In such a wire winding apparatus, when the electric motor is driven to rotate the wire drum via the worm wheel, one wire is wound by the wire drum and, on the other hand, the other wire is released from the wire drum. Therefore, for example, if the one wire is coupled to a slide door to extend forward from the slide door and the other wire is coupled to the slide door to extend backward from the slide door, it is possible to move the slide door to open and close with respect to a vehicle body (see, for example, Japanese Patent Application Laid-Open No. 2000-350406).

The pair of wires is wound around the common wire drum in the wiring winding device described above. However, it is difficult to wind the respective wires in a common winding area. The wire drum is required to separately have an area for winding one wire and an area for winding the other wire on the peripheral surface. Therefore, a space for disposing the wire drum having a large axial direction length is required on one side, of the worm wheel. In other words, the wire drum having the large axial direction length inevitably projects from the one side of the worm wheel. Thus, it is likely that this poses a significant problem in realizing a reduction in size of the wire winding apparatus.

SUMMARY OF THE INVENTION

It is an object of the present invention to at least partially solve the problems in the conventional technology.

A wire winding apparatus according to one aspect of the present invention winds one side of wire and simultaneously releases other side of wire by driving a winding actuator. A drive gear is disposed to rotate in an arbitrary direction when the winding actuator is driven. A pair of wire drums is disposed on both sides of the drive gear, respectively, and separately winds the one side of wire and the other side of wire in opposite directions. A rotation of the drive gear is transmitted to each of the wire drums.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
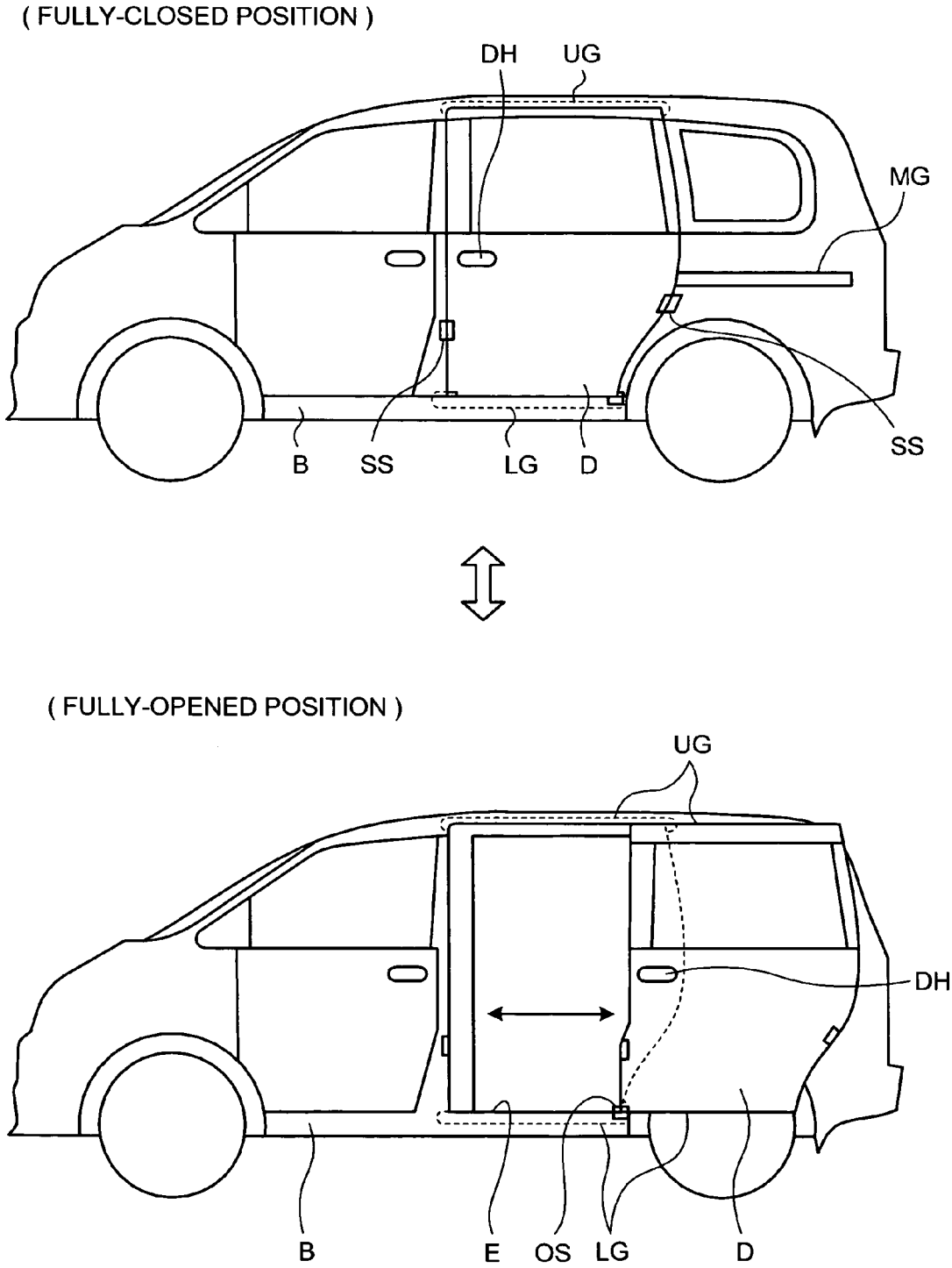
FIG. 1 is a side view of a four-wheel drive car to which a wire winding apparatus according to an embodiment of the present invention is applied.

FIG. 1 is a side view of a four-wheel drive car to which a wire winding apparatus according to an embodiment of the present invention is applied. The four-wheel drive car shown in the figure has a vehicle body B that is called one-box type. An entrance opening E that allows passengers to get on and off the car is provided in a position substantially in the center in the longitudinal direction on the side of the vehicle body B. The four-wheel drive car also has a slide door D for opening and closing the entrance opening E.

The slide door D is slidably provided on the side of the vehicle body B via an upper guide section UG provided between the slide door D and the upper end of the vehicle body B, a lower guide section LG provided between the slide door D and the lower end of the vehicle body B, and a central guide section MG provided between the slide door D and the center of the vehicle body B. When the slide door D is slid forward to be closest to the front of the vehicle body B, it is possible to place the slide door D in a position for closing the entrance opening E (hereinafter, "fully-closed position"). On the other hand, when the slide door D is slid backward to be closest to the rear of the vehicle body B, it is possible to place the slide door D in a position for opening the entrance opening E (hereinafter, "fully-opened position"). As the guide sections UG, LG, and MG, as represented by the lower guide section LG shown in FIG. 2, for example, a support frame SF including traveling rollers R is provided in the slide door D and, on the other hand, a guide rail GR for guiding the traveling rollers R is provided in the vehicle body B.

As shown in FIG. 1, full-close stopper units SS and a full-open stopper unit OS are provided between the slide door D and the vehicle body B. The full-close stopper units SS are sections for keeping the slide door D in the fully-closed position when the slide door D is slid to the position. The full-close stopper units SS are provided in two places in the front and the rear of the slide door D, namely, a place between the front edge portion of the slide door D and the vehicle body B and a place between the rear edge of the slide door D and the vehicle body B. The full-open stopper unit OS is a section for keeping the slide door D in the fully-opened position when the slide door D is slid to the position. Although not clearly shown in the figure, for example, the full-open stopper unit OS is provided between the support frame SF of the lower guide section LG and the vehicle body B. As the full-close stopper units SS and the full-open stopper unit OS, for example, a striker is provided in the vehicle body B and, on the other hand, a latch is provided in the slide door D (the support frame SF). The full-close stopper units SS and the full-open stopper unit OS only have to regulate the movement of the slide door D with respect to the vehicle body B when the striker and the latch are engaged. A state of regulation of the movement of the slide door D by the full-close stopper units SS and the full-open stopper unit OS is released by the driving of a not-shown release actuator when a door handle DH provided in the slide door D is operated or when a door switch of a remote controller is operated.

Figure 2:
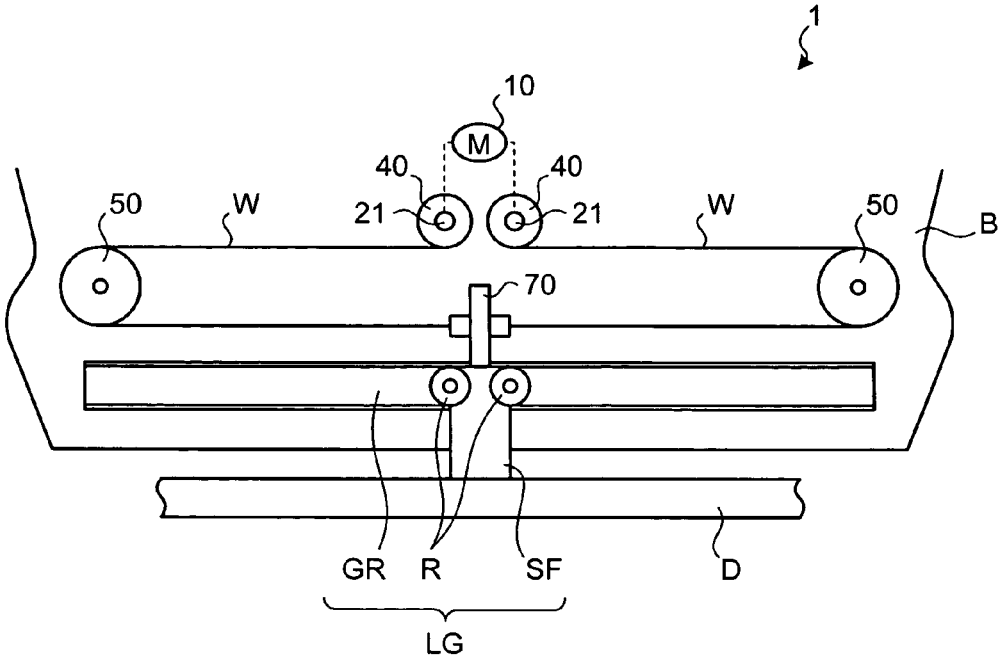
FIG. 2 is a conceptual plan view of a main part of the four-wheel drive car shown in FIG. 1.
Figure 3:
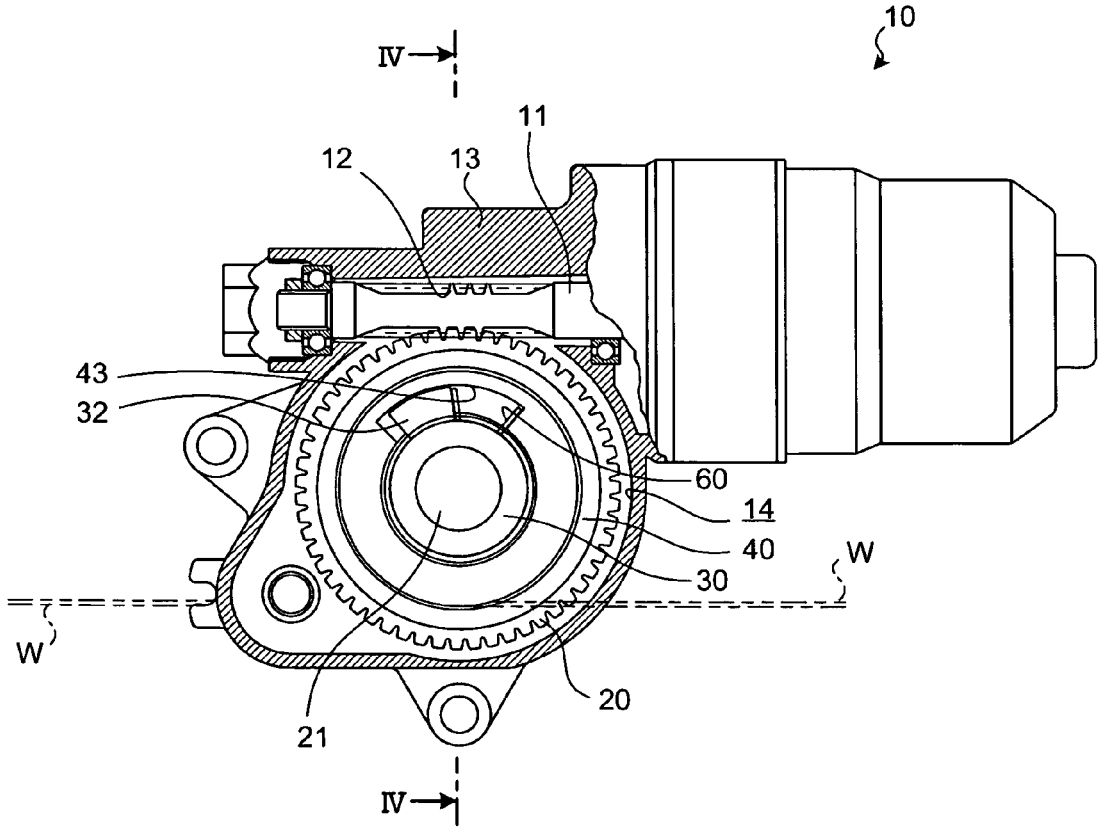
FIG. 3 is a sectional view of a main part of a wire winding apparatus applied to the four-wheel drive car shown in FIG. 1.
Figure 4:
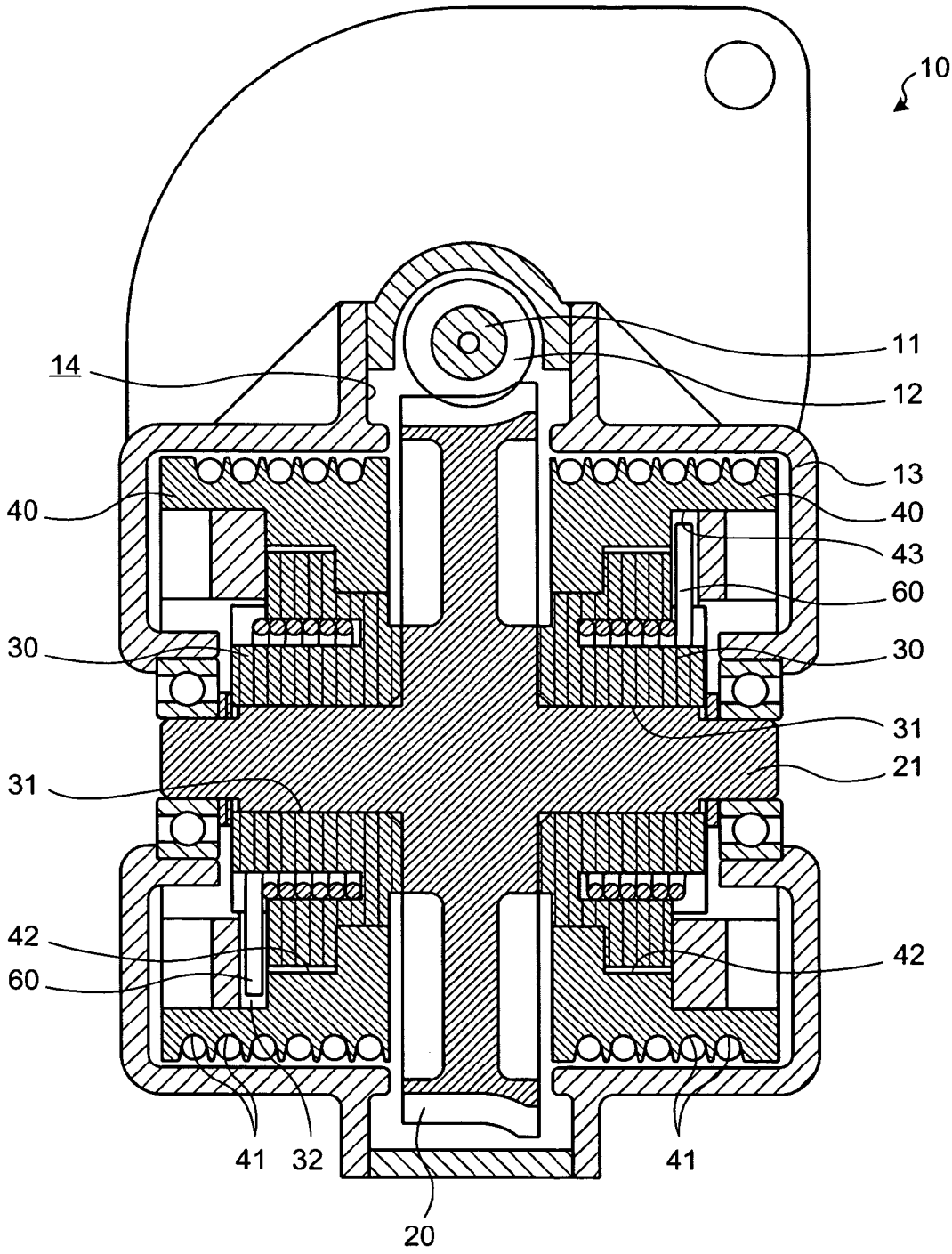
FIG. 4 is a sectional view along line IV-IV in FIG. 3.

On the other hand, in the four-wheel drive car, as shown in FIG. 2, a power slide unit 1 is provided in the vehicle body B. The power slide unit 1 is a driving device for sliding the slide door D with respect to the vehicle body B. The power slide unit 1 includes an electric motor 10 as a winding actuator. In the electric motor 10, as shown in FIGS. 3 and 4, a worm gear 12 is fastened to an output shaft 11. The worm gear 12 is attached to a device body 13 to face a housing chamber 14 of the device body 13.

As it is evident from the figures, a worm wheel 20, a pair of drum bases 30, and a pair of wire drums 40 are disposed in the housing chamber 14 of the device body 13.

The worm wheel 20 is integrally formed in the middle portion of a support shaft 21 formed relatively long. The worm wheel 20 is disposed in the device body 13 to engage with the worm gear 12 of the electric motor 10 and to be capable of rotating around the axis of the support shaft 21.

The drum bases 30 are formed in a cylindrical shape and have fitting holes 31 in the centers thereof, respectively. The drum bases 30 are disposed on both the sides of the worm wheel 20 to rotate together with the support shaft 21, respectively, by inserting the support shaft 21 in the fitting holes 31. Engaging protrusions 32 are provided in a part of the outer peripheral surfaces of the drum bases 30, respectively. The engaging protrusions 32 project in a fan shape to gradually expand in outer peripheral directions of the drum bases 30. The respective outer peripheral surfaces are formed in an arc shape with the axis of the drum bases 30 as the center.

The wire drums 40 are cylindrical members that have spiral winding grooves 41 on the outer peripheral surfaces thereof and have inserting holes 42 in the centers thereof, respectively. The wire drums 40 are disposed in the outer peripheries of the respective drum bases 30 in the housing chamber 14 of the device body 13 by rotatably inserting the drum bases 30 in the respective inserting holes 42. Although not clearly shown in the figure, the spiral winding grooves 41 formed in the wire drums 40 are grooves for winding and storing wires W on the outer peripheral surfaces of the wire drums 40. The spiral winding grooves 41 are formed such that spiral directions thereof around the support shaft 21 are opposite to each other.

In the respective wire drums 40, loose fitting recesses 43 are provided in the inner peripheral surfaces of the inserting holes 42. The loose fitting recesses 43 are formed in a fan shape to gradually expand in the outer peripheral directions of the wire drums 40. The engaging protrusions -32 of the drum bases 30 are housed in the insides of the loose fitting recesses 43, respectively. As it is evident from the figure, the loose fitting recesses 43 formed in the wire drums 40 are formed sufficiently larger than the engaging protrusions 32 of the drum bases 30 in the peripheral directions of the loose fitting recesses 43. It is possible to move the engaging protrusions 32 along the peripheral direction in the insides of the loose fitting recesses 43.

Tension springs 60 are disposed between the wire drums 40 and the drum bases 30. The tension springs 60 are interposed between end faces of the loose fitting recesses 43 formed in the wire drums 40 and end faces of the engaging projections 32 formed in the drum bases 30. The tension springs 60 urge the wire drums 40 to rotate in one direction with respect to the drum bases 30 with an elastic force thereof to give tension to the wires W released from the wire drums 40.

As shown in FIG. 2, the power slide unit 1 further includes a pair of idler pulleys 50 in the vehicle body B and includes a wire coupling plate 70 in the support frame SF of the lower guide section LG. The idler pulleys 50 are used for changing extending directions of the wires W released from the wire drum 40. The idler pulleys 50 are arranged in parallel to each other in the front and the rear of the vehicle body B such that rotation axes thereof extend in the vertical direction. The wire coupling plate 70 is a plate-like member projected toward the vehicle body B from the support frame SF. The wire coupling plate 70 is disposed such that a projecting end thereof faces a space between the rotation axes of the idler pulleys 50.

The power slide unit 1 having the constitution described above is attached to the vehicle body B via the device body 13 such that the support shaft 21 for the worm wheel 20 extends in the vertical direction in a position between the pair of idler pulleys 50. The wire W released from one of the wire drums 40 toward the front side of the vehicle body B is wound around one of the idler pulleys 50 to be turned. The end of the wire W extending toward the rear of the vehicle is coupled to the front surface of the wire coupling plate 70. On the other hand, the wire W released from other of the wire drums 40 toward the rear side of the vehicle body B is wound around other of the idler pulleys 50 to be turned. The end of the wire W extending toward the front of the vehicle is coupled to the rear surface of the wire coupling plate 70. The power slide unit 1 is set in this state.

Figure 5:
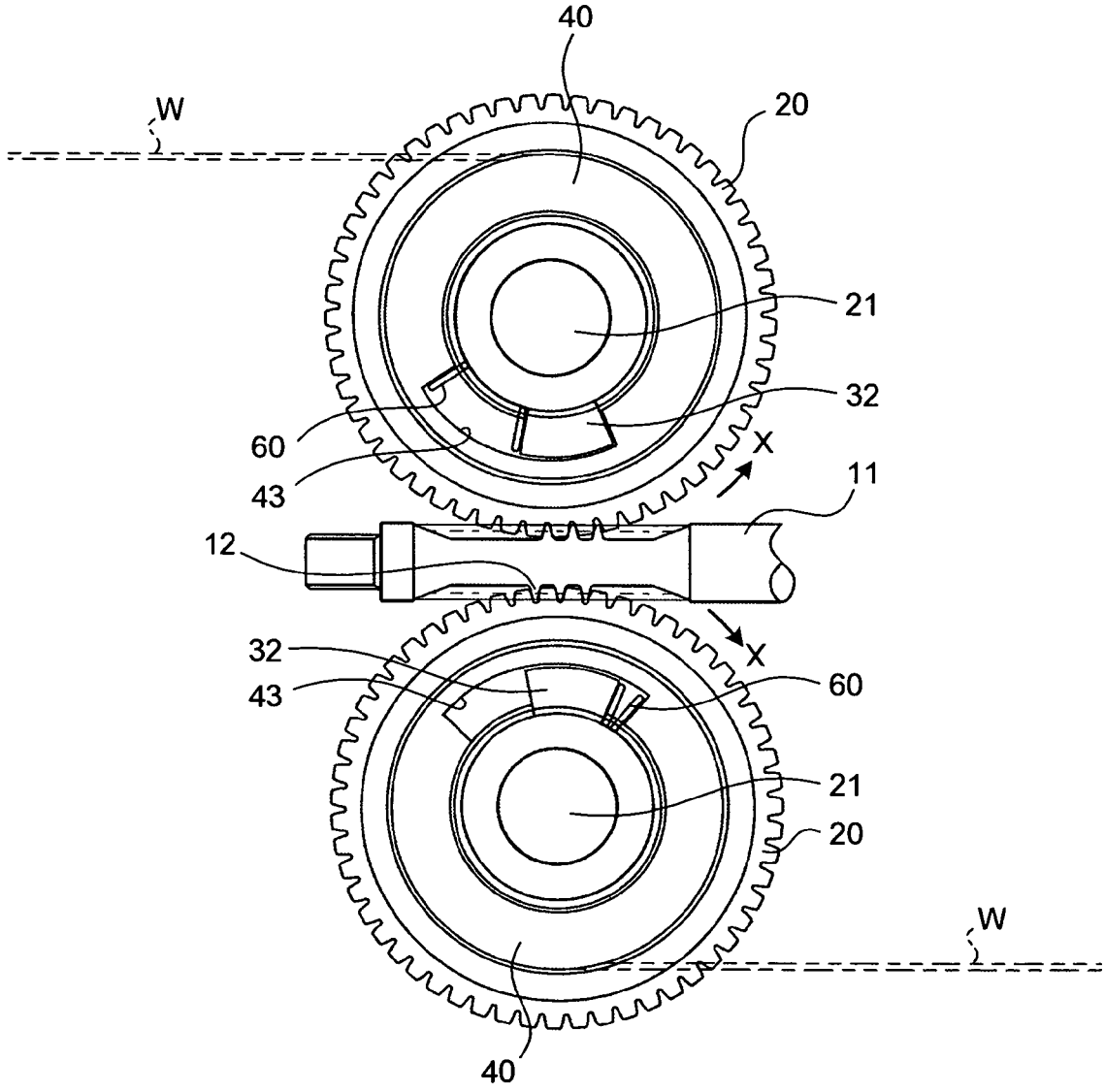
FIG. 5 is a conceptual exploded view of the wire winding apparatus shown in FIG. 3.
Figure 6:
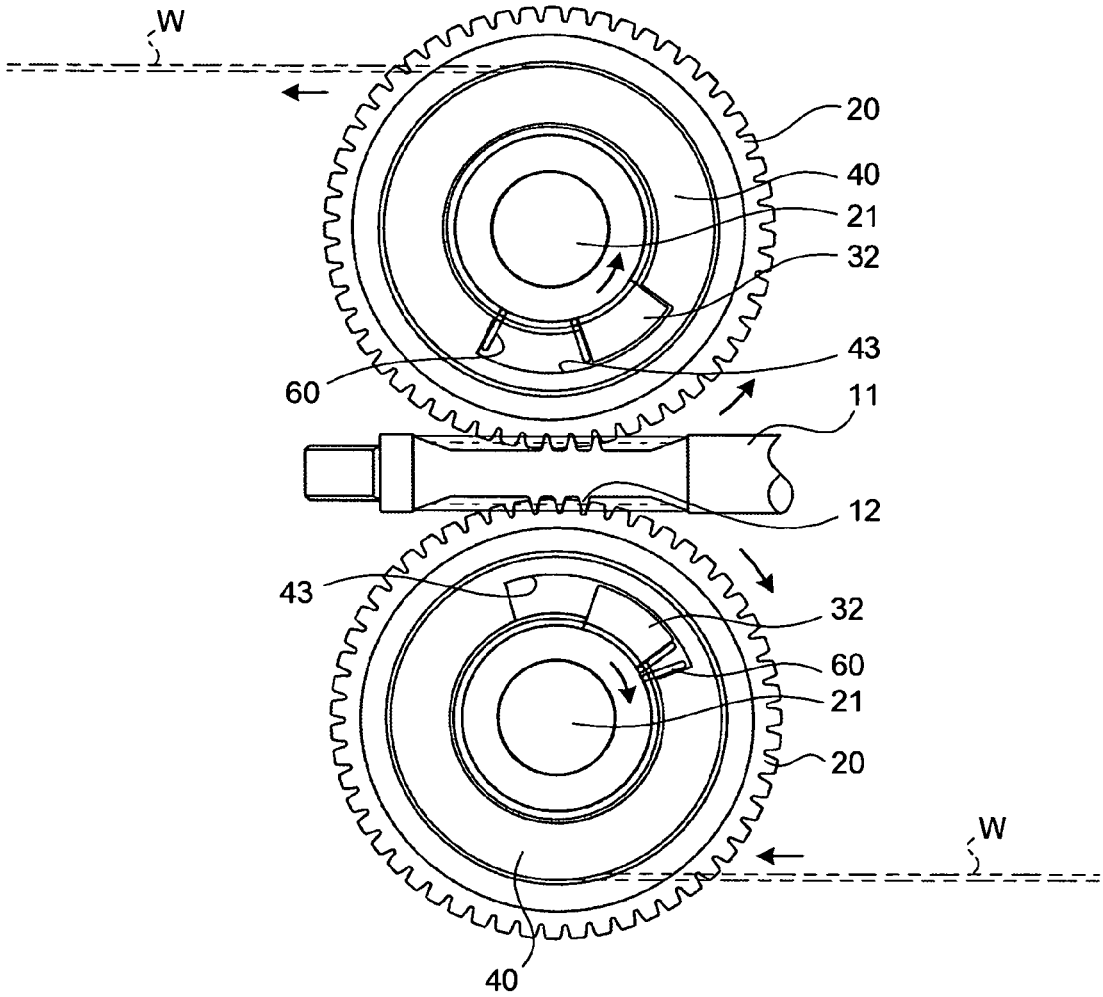
FIG. 6 is a conceptual exploded view of the wire winding apparatus shown in FIG. 3.

In the power slide unit 1, when the electric motor 10 is driven to rotate the worm wheel 20 in a direction indicated by an arrow X, for example, as shown in an exploded view in FIG. 5, one of the wire drums 40 drawn on the lower side in FIG. 5 rotates in a direction identical with the rotating direction of the worm wheel 20 via the support shaft 21, the drum base 30, and the tension spring 60. The wire W is gradually wound around the outer peripheral surface of the wire drum 40 as shown in the lower side in FIG. 6.

On the other hand, the other of the wire drums 40 drawn on the upper side in FIG. 5 rotates in a direction identical with the rotating direction of the worm wheel 20 via the support shaft 21 and the drum base 30. As shown on the upper side in FIG. 6, the wire W is gradually released from the outer peripheral surface of the wire drum 40.

Therefore, if the full-open stopper unit OS and the full-close stopper units SS are released by operating the door handle DH provided in the slide door D and the door switch of the remote controller to drive the power slide unit 1 from this state, it is possible to slide the slide door D in an appropriate direction with respect to the vehicle body D through the wire coupling plate 70 and the support frame SF. This makes it possible to move the slide door D from the fully-closed position to the fully-opened position or from the fully-opened position to the fully-closed position.

Figure 7:
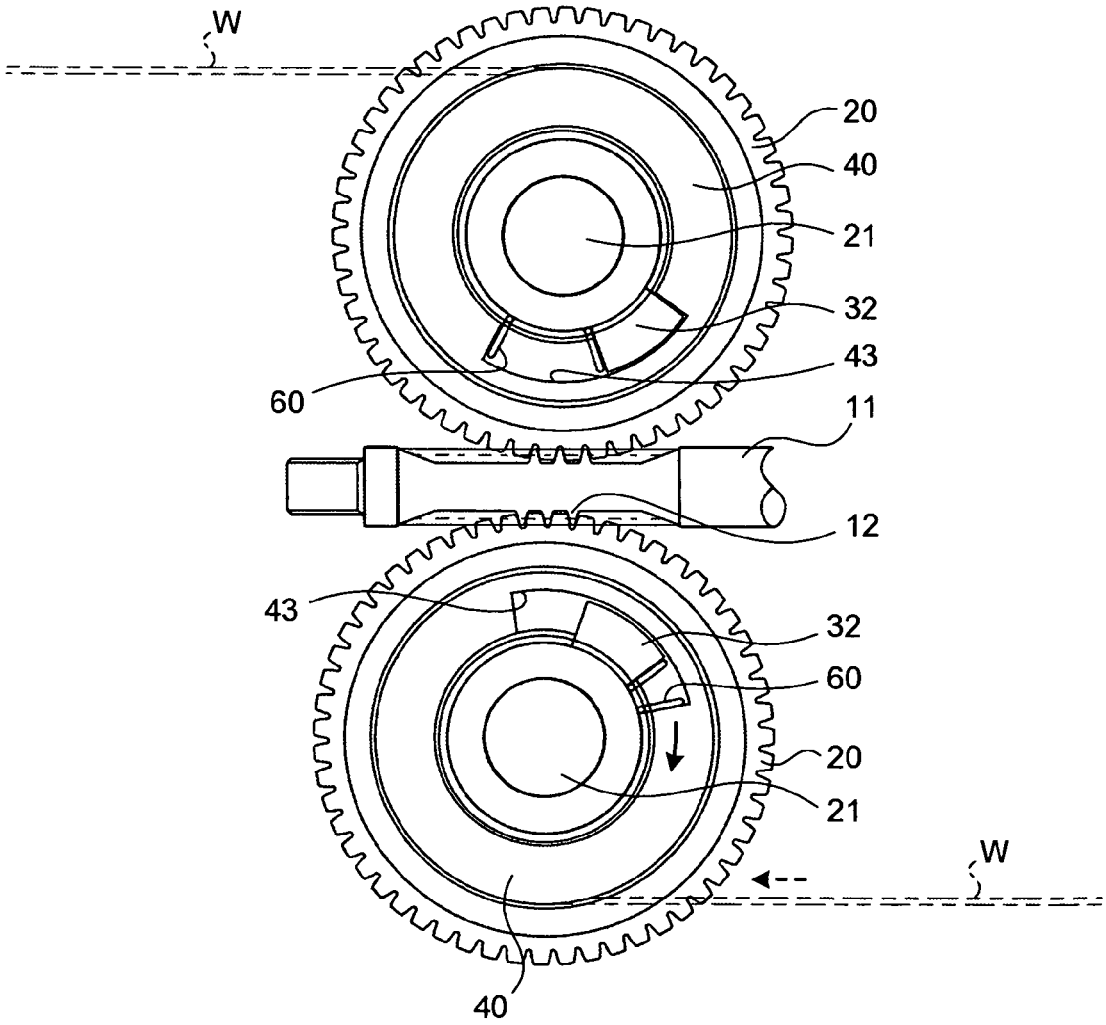
FIG. 7 is a conceptual exploded view of the wire winding apparatus shown in FIG. 3.

In the power slide unit 1, when the driving of the electric motor 10 is stopped, as shown in FIG. 7, the respective wire drums 40 are rotated with respect to the drum bases 30 by an elastic force of the tension springs 60 in a direction for applying tension to the wires W. Therefore, even when there is fluctuation in the length direction in the wires W used in assembling the power slide unit 1 or even when stretch due to use occurs in the wires W, it is not likely that slack is caused in the wires W released from the wire drums 40.

Moreover, in the power slide unit 1, one wire W and the other wire W are wound around the separate wire drums 40, respectively. This makes it possible to interpose the tension springs 60 between the worm wheel 20 and the wire drums 40. In other words, it is possible to build a tension imparting unit for imparting tension to the wires W in the power slide unit 1. Therefore, it is unnecessary to separately provide a unit for imparting tension to the wires W released from the wire drums 40. This is advantageous in terms of an installation space.

The wire drums 40 only have to have an axial direction length sufficient for winding the wires W, respectively. Moreover, the wire drums 40 are disposed on both the sides of the worm wheel 20. Thus, it is unnecessary to adopt a constitution in which a component projects from one side of the worm wheel 20 by a large amount. In particular, according to the present embodiment, the worm wheels 20 engaging with the worm gear 12 provided in the output shaft 11 of the electric motor 10 are adopted as the drive gear. This makes it possible to constitute the worm wheel 20 and the pair of wire drums 40 within an overall width of the electric motor 10. This is extremely advantageous in realizing a reduction in size the wire winding apparatus.

According to the present embodiment, the wire winding apparatus applied to the power slide unit 1 for sliding the slide door D of the four-wheel drive car is described as an example. However, the wire winding apparatus is not always limited to the one for sliding the slide door D of the four-wheel drive car. For example, in the case of a vehicle, it is also possible to apply the wire winding apparatus as a driving device for sliding window glass or sunroof glass.

According to an embodiment of the present invention, the wire drums having a size sufficient for winding separate wires only have to be disposed on the sides of the drive gear. This makes it possible to hold down an amount of projection of the wide drums from the sides of the drive gear and realize a reduction in size of the wire winding apparatus.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

This application claims priority from Japanese Patent Application 2005-303505, filed Oct. 18, 2005, which is incorporated herein by reference in its entirety.

What is claimed is:

1. A wire winding apparatus that opens and closes a single door with two wires, a first wire of which is wound and the second wire of which is simultaneously released by driving a winding actuator, the wire winding apparatus comprising:

a drive gear that is disposed in a main body of the wire winding apparatus, in such a manner that the drive gear rotates in an arbitrary direction driven by the winding actuator, wherein the winding actuator is a motor that includes an output shaft and a worm gear on the output shaft, and the drive gear includes a single worm wheel that engages with the worm gear; and a pair of wire drums that is disposed on both sides of a support shaft of the worm wheel of the drive gear, respectively, such that a rotation of the drive gear is transmitted to each of the wire drums, wherein the pair of wire drums have spiral winding grooves which are spiraled in an opposite direction to one another, and are configured to separately load the first wire and the second wire.

2. The wire winding apparatus according to claim 1, further comprising:

a tension imparting unit that is provided between the worm gear and the wire drums, wherein the tension imparting unit is configured to impart a tension to a wire released from the wire drums.

3. The wire winding apparatus according to claim 2, wherein the tension imparting unit comprises a tension spring configured to urge at least one of the wire drums to rotate in one direction with respect to a drum base with an elastic force thereof to provide tension to the wire released from the wire drum, wherein the tension spring is interposed between an end face of a loose fitting recess formed in the at least one of the wire drums and an end face of an engaging projection formed in the drum base, the loose fitting recess being formed larger than the engaging projection in a peripheral direction of the loose fitting recess.

* * * * *